US007248673B2

(12) United States Patent
Miller

(10) Patent No.: US 7,248,673 B2
(45) **Date of Patent: *Jul. 24, 2007**

(54) INTEGRATED COMPONENT MOUNTING SYSTEM

(75) Inventor: Robert Steven Miller, Sandy, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 204 days.

This patent is subject to a terminal disclaimer.

(21) Appl. No.: 10/989,569

(22) Filed: Nov. 15, 2004

(65) Prior Publication Data

US 2005/0160588 A1 Jul. 28, 2005

Related U.S. Application Data

(62) Division of application No. 10/017,698, filed on Dec. 7, 2001, now Pat. No. 6,819,742.

(51) Int. Cl.
*H01J 35/10* (2006.01)

(52) U.S. Cl. ..... 378/144; 378/125

(58) Field of Classification Search ..... 378/125, 378/131, 132, 143, 144
See application file for complete search history.

(56) References Cited

U.S. PATENT DOCUMENTS 3,795,832 A 3/1974 Holland
3,855,492 A 12/1974 Langer et al.
4,141,606 A 2/1979 Yamamura
4,272,696 A 6/1981 Stroble et al.
4,670,895 A 6/1987 Penato et al.
4,949,368 A 8/1990 Kubo
5,303,280 A 4/1994 Crawford et al.
5,308,172 A 5/1994 Upadhya et al.
5,357,552 A 10/1994 Kutschera
5,425,067 A 6/1995 Sano et al.
5,498,186 A 3/1996 Benz et al.
5,588,035 A 12/1996 Christean et al.
5,655,000 A 8/1997 Benz et al.
5,699,401 A 12/1997 Jackson et al.
5,838,762 A 11/1998 Ganin et al.
5,875,227 A 2/1999 Bhatt
6,088,426 A 7/2000 Miller
6,125,168 A 9/2000 Bhatt
6,751,293 B1 6/2004 Barrett
6,819,742 B1 * 11/2004 Miller ..... 378/144

* cited by examiner

*Primary Examiner*—Courtney Thomas
(74) *Attorney, Agent, or Firm*—Workman Nydegger

(57) ABSTRACT

An integrated component mounting system that includes a component mounted to a shaft and secured in place by a nut. The component and the nut each define respective annular shaped surfaces. The shaped surfaces are each inclined at a similar angle and are arranged for sliding contact with respect to each other. As the nut is tightened on the shaft, the shaped surface of the nut exerts both radial and axial forces on the shaped surface of the component, thereby automatically centering the component radially on the shaft as well as securing the component at a desired location along the shaft.

33 Claims, 6 Drawing Sheets

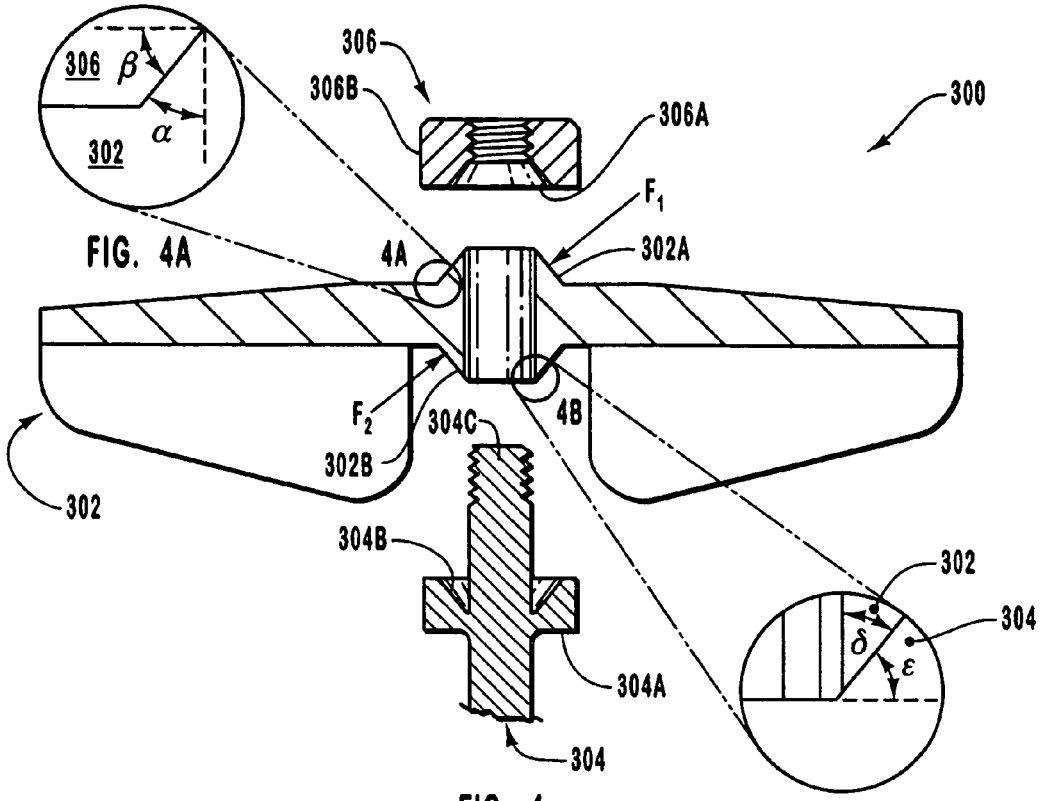
FIG. 4A
FIG. 4
FIG. 4B
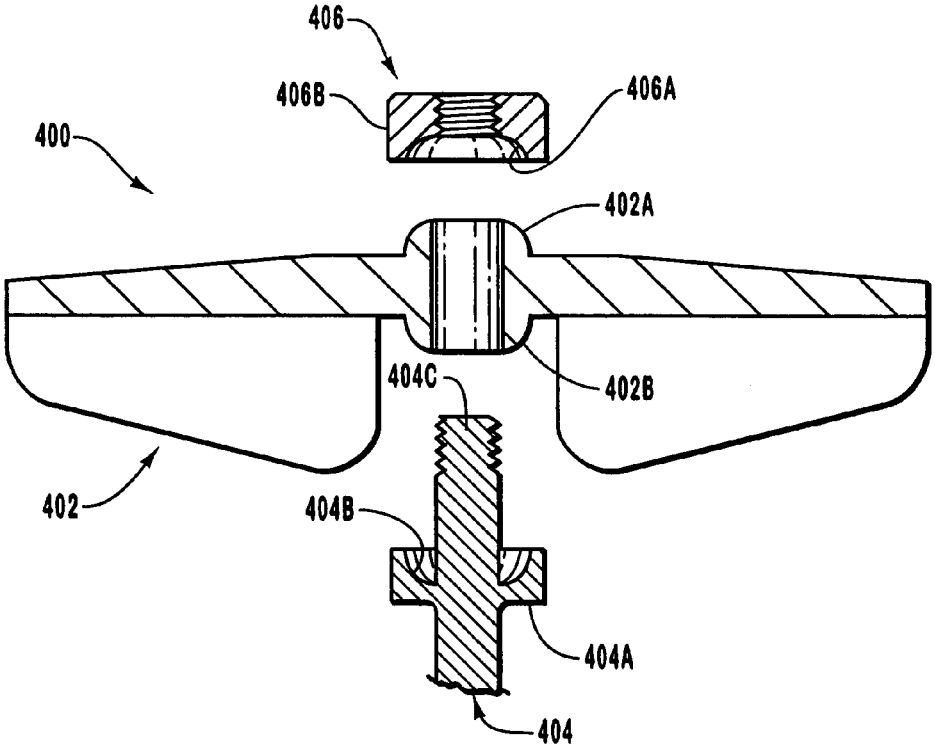
FIG. 5

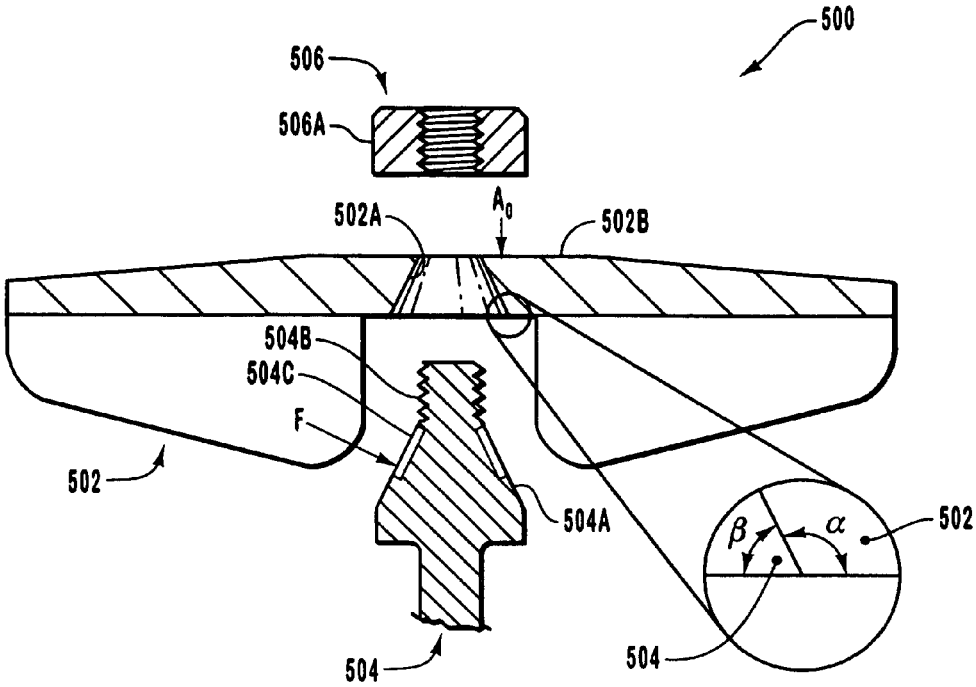
FIG. 6
FIG. 6A
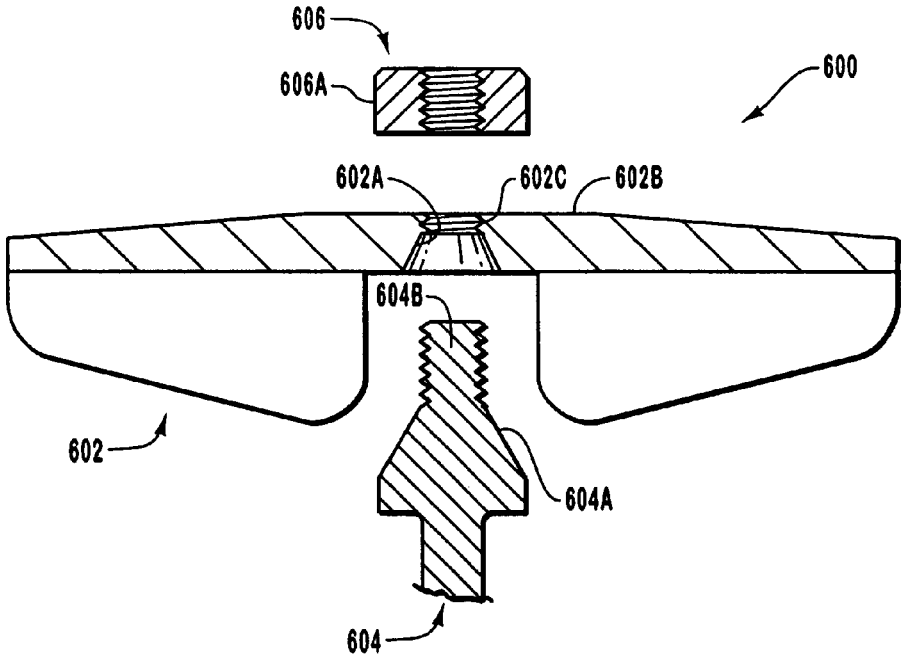
FIG. 7

INTEGRATED COMPONENT MOUNTING SYSTEM

CROSS-REFERENCE TO RELATED APPLICATIONS

This application is a divisional application, and claims the benefit of U.S. patent application Ser. No. 10/017,698, filed Dec. 7, 2001, and entitled INTEGRATED COMPONENT MOUNTING SYSTEM, which will issue as U.S. Pat. No. 6,819,742 on Nov. 16, 2004. That application is incorporated herein by reference in its entirety.

BACKGROUND OF THE INVENTION

1. The Field of the Invention

The present invention relates generally to mounting systems for positioning and securing a component on a shaft. More particularly, embodiments of the present invention relate to target anode mounting systems and devices that include various features which serve to reliably and effectively establish and maintain the both the axial and radial position of the target anode in a variety of operating conditions.

2. Related Technology

X-ray producing devices are valuable tools that are used in a wide variety of industrial, medical, and other applications. For example, such equipment is commonly used in areas such as diagnostic and therapeutic radiology, semiconductor manufacture and fabrication, and materials analysis and testing. While they are used in various different applications, the different x-ray devices share the same underlying operational principles. In general, x-rays, or x-ray radiation, are produced when electrons are produced, accelerated, and then impinged upon a material of a particular composition.

Typically, these processes are carried out within a vacuum enclosure. Disposed within the vacuum enclosure is an electron generator, or cathode, and a target anode, which is spaced apart from the cathode. In operation, electrical power is applied to a filament portion of the cathode, which causes a stream of electrons to be emitted by the process of thermionic emission. A high voltage potential applied across the anode and the cathode causes the electrons emitted from the cathode to rapidly accelerate towards a target surface, or focal track, positioned on the target anode.

The accelerating electrons in the stream strike the target surface, typically a refractory metal having a high atomic number, at a high velocity and a portion of the kinetic energy of the striking electron stream is converted to electromagnetic waves of very high frequency, or x-rays. The resulting x-rays emanate from the target surface, and are then collimated through a window formed in the x-ray tube for penetration into an object, such as the body of a patient. As is well known, the x-rays can be used for therapeutic treatment, or for x-ray medical diagnostic examination or material analysis procedures.

Due to the nature of the operation of an x-ray tube, components of the x-ray tube are subjected to a variety of demanding operating conditions. For example, in addition to stimulating the production of x-rays, the kinetic energy of the striking electron stream also causes a significant amount of heat to be produced in the target anode. As a result, the target anode typically experiences extremely high operating temperatures, as high as 2300° C. during normal operations. However, the anode is not the only element of the x-ray tube subjected to such operating temperatures. For example, components such as the shaft, and the nut which secures the target anode on the shaft, are also exposed to these high temperatures as a result of their proximity to, and substantial contact with, the target anode.

In addition to experiencing high operating temperatures, the components of the x-ray device are also exposed to thermal stress cycling situations where relatively wide variations in operating temperature may occur in a relatively short period of time. By way of example, the temperature in the region of the target anode may, in some cases, increase from about 20° C. to about 1250° C. in a matter of minutes. The relatively rapid rate at which such temperature changes take place imposes high levels of thermally-induced stress and strain in the x-ray tube components.

Further, many of the rotating components of a typical rotating anode type x-ray device are additionally subjected to high levels of non-thermally induced mechanical stress induced by high speed rotation of the anode and shaft. For example, in many rotating anode type x-ray devices, the anode, the shaft and the nut used to attach the anode to the shaft, are subjected to high stress "boost and brake" cycles. In a typical boost and brake cycle, the anode may be accelerated from zero to ten thousand (10,000) revolutions per minute (RPM) in less than ten seconds. This high rate of acceleration imposes significant mechanical stresses on the anode, the shaft and the nut. Thus, the components which are used to secure the anode in position are exposed not only to extreme thermal stresses, but are simultaneously exposed to significant stresses imposed by the mechanical operations of the x-ray device.

The operating conditions just described have a variety of effects that may be detrimental to the operation and service life of the x-ray tube. At least some of such effects concern the attachment of the target anode to the shaft.

For example, it may be desirable in some instances to define a gap between the outside diameter of the shaft and the opening in the anode through which the shaft passes. Such a gap would permit manipulation of anode orientation prior to operation of the x-ray device. In particular, the gap allows the assembler to attempt to minimize anode run-out with respect to the shaft by shifting the lateral, or radial, position of the anode slightly prior to tightening the nut. However, while such a gap may be useful in the sense that it permits initial positioning of the anode with respect to the shaft, the gap also allows the possibility of undesirable lateral movement, or radial runout, of the anode when the anode is subjected to mechanical and thermal stresses.

Failure to compensate for, or otherwise eliminate, such radial runout by limiting or preventing the movement of the target anode may cause problems with the operation of the device. For example, high operational speeds and mechanical stresses may cause a target anode that is relatively unconstrained from radial movement to vibrate and produce noise during operation of the x-ray device. Vibration may also result when the target anode is not centered with respect to the rotor shaft. Such vibration and noise, in turn, have various negative consequences with respect to the performance and operational life of the x-ray device.

For example, vibration and/or movement of the target anode will cause corresponding movement of the focal spot on the target surface of the anode. Because high quality imaging depends upon reliable maintenance of focal spot positioning, any such focal spot movement will compromise the quality of the images that can be produced with the x-ray device. Furthermore, unchecked vibration may ultimately damage the target anode, shaft, the nut, or other components of the x-ray device. Moreover, noise and vibration may be unsettling to the x-ray device operator and the x-ray subject, particularly in mammographic applications where the subject is in relatively intimate contact with the x-ray device.

In view of the foregoing problems, and others, a need exists for a component mounting system that substantially prevents radial runout of the mounted component and thereby substantially reduces the noise, vibration, and other effects associated with unbalanced and inadequately unconstrained components.

BRIEF SUMMARY OF VARIOUS FEATURES OF THE INVENTION

The present invention has been developed in response to the current state of the art, and in particular, in response to these and other problems and needs that have not been fully or adequately resolved by currently available component mounting systems.

Briefly summarized, embodiments of the present invention provide an integrate component mounting system that facilitates radial positioning of the component, relative to a shaft to which the component is mounted, as well as the maintenance of a desired radial and axial position of the component.

Embodiments of the present invention are particularly well suited for use in rotating anode type x-ray tubes. However, embodiments of the present invention are suitable for use in any application or environment where it is useful to establish and maintain a desired lateral and axial position of a shaft mounted component and thereby reduce the noise, vibration, and the other undesirable effects associated with unbalanced and inadequately secured components.

In one embodiment of the invention, an integrated component mounting system is provided that includes a component configured to be mounted to a shaft. The shaft includes a threaded segment and a support member. The shaft is configured so that at least a portion of the threaded segment resides within a hole defined by the component when the component is seated on the support member. A nut serves to secure the component to the shaft. Finally, the nut and the component each comprise a respective surface having a geometry that is complementary with the geometry of the other.

As the nut is tightened and comes into contact with the component, the shaped surfaces cooperate in such a way that radial and axial forces are simultaneously applied to the component. The axial force serves to facilitate positioning of the component against the support member of the shaft, while the radial force facilitates the centering of the component with respect to the shaft.

In this way, the shaped surfaces cooperate with each other to insure that, regardless of the initial orientation of the component on the shaft, the component will be centered on the shaft, and securely positioned against the support member, upon completion of the tightening of the nut. Further, the axial force exerted as a result of the cooperation of the shaped surfaces acts to substantially foreclose radial runout of the component during operation and thereby helps prevent unbalanced rotary motion of the component.

These and other features and advantages of the present invention will become more fully apparent from the following description and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which:

FIG. 4 is an exploded cross-section view illustrating an alternative embodiment of an integrated component mounting system, wherein the nut, component, and shaft all include shaped surfaces;

FIG. 4A is a close-up view of a portion of the integrated component mounting system of FIG. 4;

FIG. 4B is a close-up view of another portion of the integrated component mounting system of FIG. 4;

FIG. 5 is an exploded cross-section view illustrating another embodiment of an integrated component mounting system, wherein the nut, component, and shaft all include shaped surfaces characterized by various curved geometries;

FIG. 6 is an exploded cross-section view illustrating yet another alternative embodiment of an integrated component mounting system, wherein only the component and the shaft include shaped surfaces;

FIG. 6A is a close-up view of a portion of the integrated component mounting system shown in FIG. 6;

FIG. 7 is an exploded cross-section view illustrating a further alternative embodiment of an integrated component mounting system wherein the component and shaft include shaped surfaces and wherein a portion of the component is threaded.

DETAILED DESCRIPTION OF VARIOUS EMBODIMENTS OF THE INVENTION

Reference will now be made to figures wherein like structures will be provided with like reference designations. It is to be understood that the drawings are diagrammatic and schematic representations of various embodiments of the invention, and are not to be construed as limiting the present invention, nor are the drawings necessarily drawn to scale.

Figure 1:
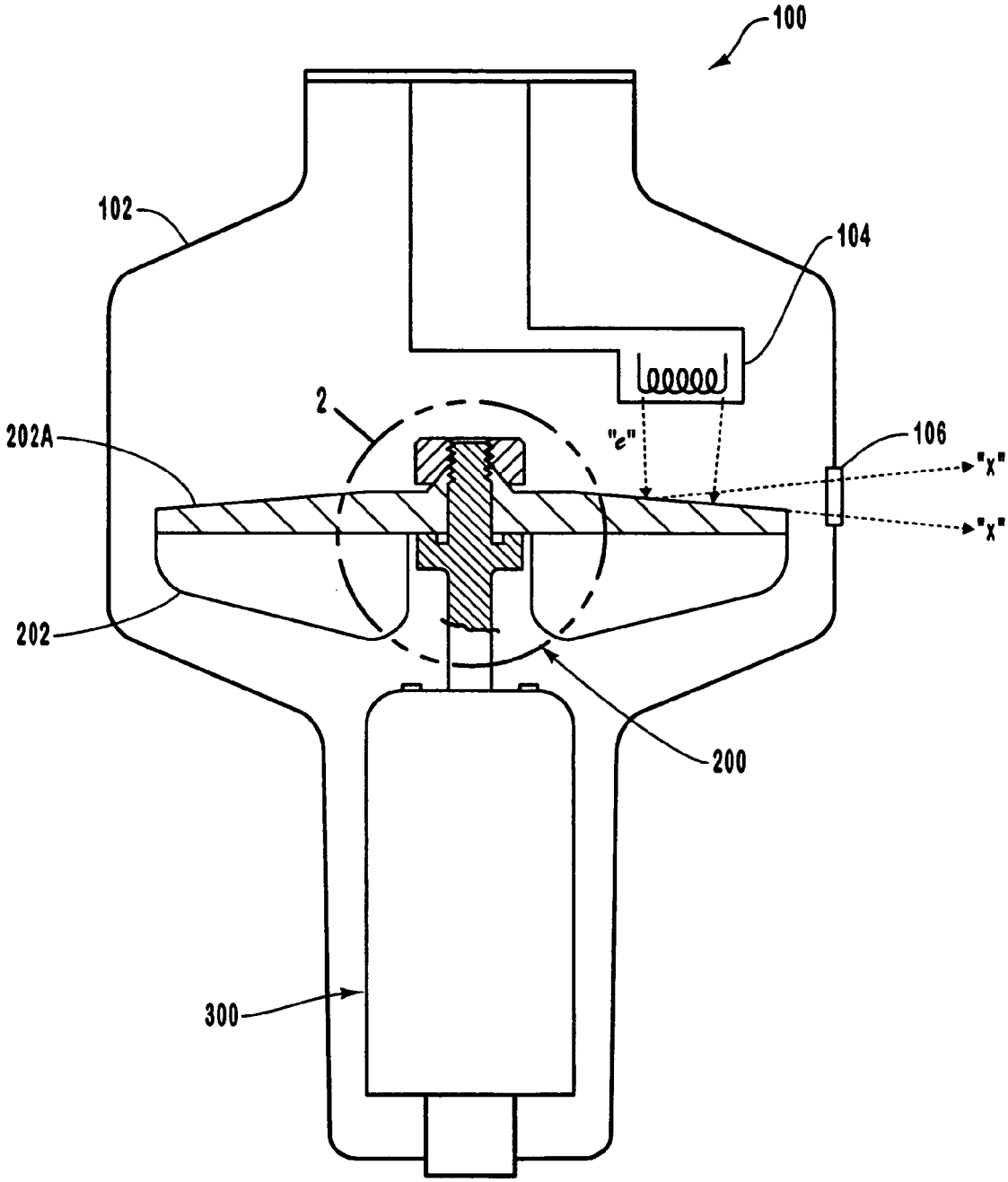
FIG. 1 illustrates an exemplary operating environment for embodiments of the present invention, and specifically illustrates a rotating anode type x-ray device.

Reference is first made to FIG. 1, wherein an x-ray tube is indicated generally at 100. Note that x-ray tube 100 is simply an exemplary operating environment for embodiments of the present invention and that such embodiments may profitably be employed in any other environment where it is desired to implement the functionality disclosed herein. By way of example, some embodiments of the invention may be used in conjunction with components such as pump impellers.

As indicated in the illustrated embodiment, x-ray tube 100 includes a vacuum enclosure 102, inside which is disposed an electron source 104, such as a cathode. An integrated component mounting system ("ICMS") 200, rotatably supported by bearing assembly 300, is likewise disposed within vacuum enclosure 102 and includes an anode 202 arranged in a spaced-apart configuration with respect to electron source 104.

Anode 202 includes a target surface 202A, preferably comprising a refractory metal such as tungsten or the like, positioned to receive electrons emitted by electron source 104. Finally, x-ray tube 100 includes a window 106, preferably comprising beryllium or a similar material, through which the x-rays produced by x-ray tube 100 pass.

With continuing attention to FIG. 1, details are provided regarding various operational features of the illustrated embodiment of x-ray tube 100. In operation, a stator (not shown) disposed about bearing assembly 300 causes anode 202 to rotate at high speed. Power applied to electron source 104 causes electrons, denoted at "e" in FIG. 1, to be emitted by thermionic emission and a high voltage potential applied across electron source 104 and anode 202 causes the emitted electrons "e" to rapidly accelerate from electron source 104 toward target surface 202A of anode 202. Upon reaching anode 202, electrons "e" strike target surface 202A causing x-rays, denoted at "x" in FIG. 1 to be produced. The x-rays, denoted at "x," are then collimated and directed through window 106 and into an appropriate subject, such as the body of a patient.

Figure 2:
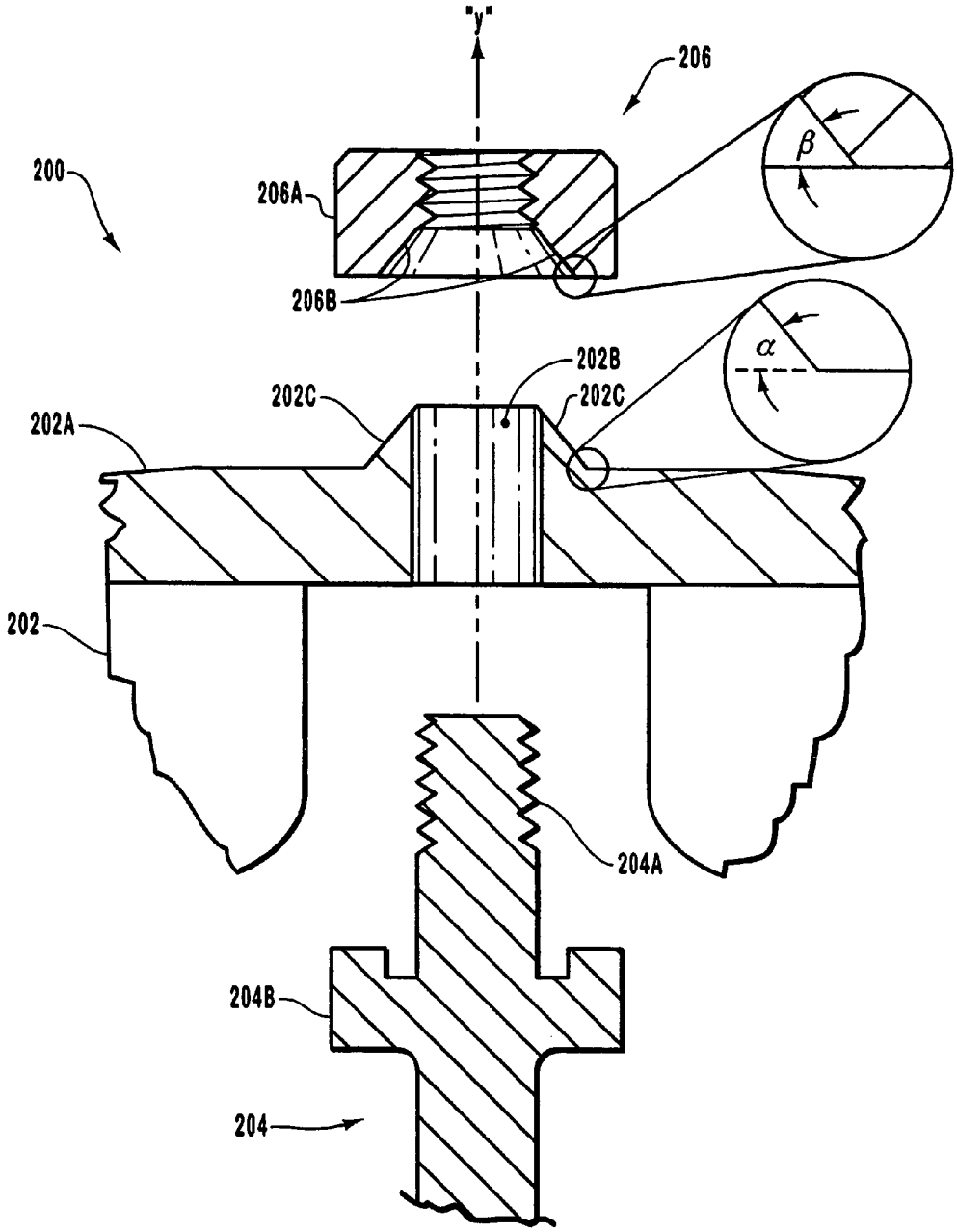
FIG. 2 is an exploded view indicating various components of an embodiment of an integrated component mounting system.

Directing attention now to FIG. 2, various details are provided regarding an embodiment of ICMS 200. Generally, the ICMS is referred to as "integrated" because, in some embodiments of the invention, a portion of the component that is to be mounted is itself an element of the mounting system.

In the illustrated embodiment, ICMS 200 includes, in addition to anode 202 discussed above, a shaft 204 having a threaded segment 204A, configured to be at least partially received within a hole 202B defined by anode 202, as well as a support member 204B that may or may not be integral with shaft 204. Any other structure that provides the functionality of support member 204B may alternatively be employed. Note that, as discussed in the context of various alternative embodiments of ICMS 200, shaft 204 need not include a support member 204B in all cases.

In general, shaft 204 is composed of metals or metal alloys having properties that are appropriate for use in high energy and high heat environments such as are commonly associated with rotating anode type x-ray devices. However, various other materials may alternatively be employed as required to suit a particular application or operating environment.

Finally, ICMS 200 includes a nut 206 configured to engage threaded segment 204A of shaft 204 and thereby establish and maintain anode 202 in a desired location and orientation. Nut 206 includes wrench flats 206A, or equivalent structure, which permit advancement and tightening of nut 206 on threaded segment 204A of shaft 204. As in the case of shaft 204, nut 206 may comprise metals or metal alloys having properties that are appropriate for use in rotating anode type x-ray devices. Other materials for nut 206 may be substituted as required to suit a particular application.

With continuing reference to FIG. 2, anode 202 and nut 206 each define respective shaped surfaces 202C and 206B which are generally annular in configuration and substantially continuous. However, one or both of shaped surfaces 202C and 206B may alternatively comprise a plurality of discrete surfaces disposed about axis "y" in a desired arrangement.

In the illustrated embodiment, shaped surfaces 202C and 206B describe, respectively, inclination angles $\alpha$ (alpha) and $\beta$ (beta) having values such that shaped surfaces 202C and 206B are able to implement the functionality disclosed herein. For a given inclination angle $\alpha$, a range of values of inclination angle $\beta$ may be effectively employed, and vice versa. Further, inclination angles $\alpha$ and/or $\beta$ may be varied as required to suit particular applications, or the use of particular materials.

While, in the illustrated embodiment, shaped surfaces 202C and 206B are preferably defined by anode 202 and nut 206, respectively, such shaped surfaces may also be defined by one or more separate discrete structures attached to, or used in conjunction with, anode 202 and nut 206. By way of example, shaped surface 206B may alternatively be defined by a separate threaded element, disposed on threaded segment 204A, and retained in position by way of a jam nut (not shown). Furthermore, shaped surfaces may alternatively be defined by components other than, or in addition to, anode 202 and nut 206. For example, in one alternative embodiment discussed herein, shaft 204 defines one of the shaped surfaces.

As discussed above, the particular structural elements used to implement the functionality disclosed herein may be varied as required to suit a particular application, and the scope of the present invention should, accordingly, not be construed to be limited to any particular structural configuration. The same is likewise true with respect to the geometry of shaped surfaces, such as 202C and 206B. Thus, variables including, but not limited to, the number, size, and geometry of the shaped surfaces, as well as the nature of the structural elements that define such shaped surfaces, may be varied as required to suit a particular application. In general, any structure or structural combination that implements the functionality disclosed herein may be employed. Shaped surfaces 202C and 206B, as well as the other embodiments disclosed herein, simply represent exemplary geometries.

As suggested by the foregoing and as discussed in detail below, various means may be employed to perform the functions, disclosed herein, of nut 206 and shaped surfaces. 202C and 206B illustrated in FIG. 2. Thus, the structural configuration comprising nut 206 and shaped surfaces 202C and 206A is but one example of a means for exerting and transmitting a radial force. Accordingly, it should be understood that the structural configurations disclosed herein are presented solely by way of example and should not be construed as limiting the scope of the present invention in any way. Other exemplary structural configurations are discussed herein with reference to FIGS. 4 through 7.

Note that, in connection with the foregoing, "radial force" refers to any force, whether positive or negative, that acts primarily along an axis generally perpendicular to longitudinal axis "y" defined by shaft 204. Moreover, in at least some embodiments of the invention, the means for exerting and transmitting a radial force also exerts an "axial force." Generally, "axial force" refers to any force, whether positive or negative, that acts primarily along an axis generally parallel to longitudinal axis "y". The axial force serves to, among other things, control axial motion of anode 202, wherein such control includes permitting, or imposing, a desired amount of axial motion of/on anode 202, as well as substantially preventing axial motion of anode 202. Similarly, the radial force serves to, among other things, control radial motion of anode 202, wherein such control includes permitting, or imposing, a desired amount of radial motion of/on anode 202, as well as substantially preventing radial motion of anode 202. As discussed in greater detail elsewhere herein, the radial force and axial force are, in some instances, exerted simultaneously.

Figures 3, 3A:
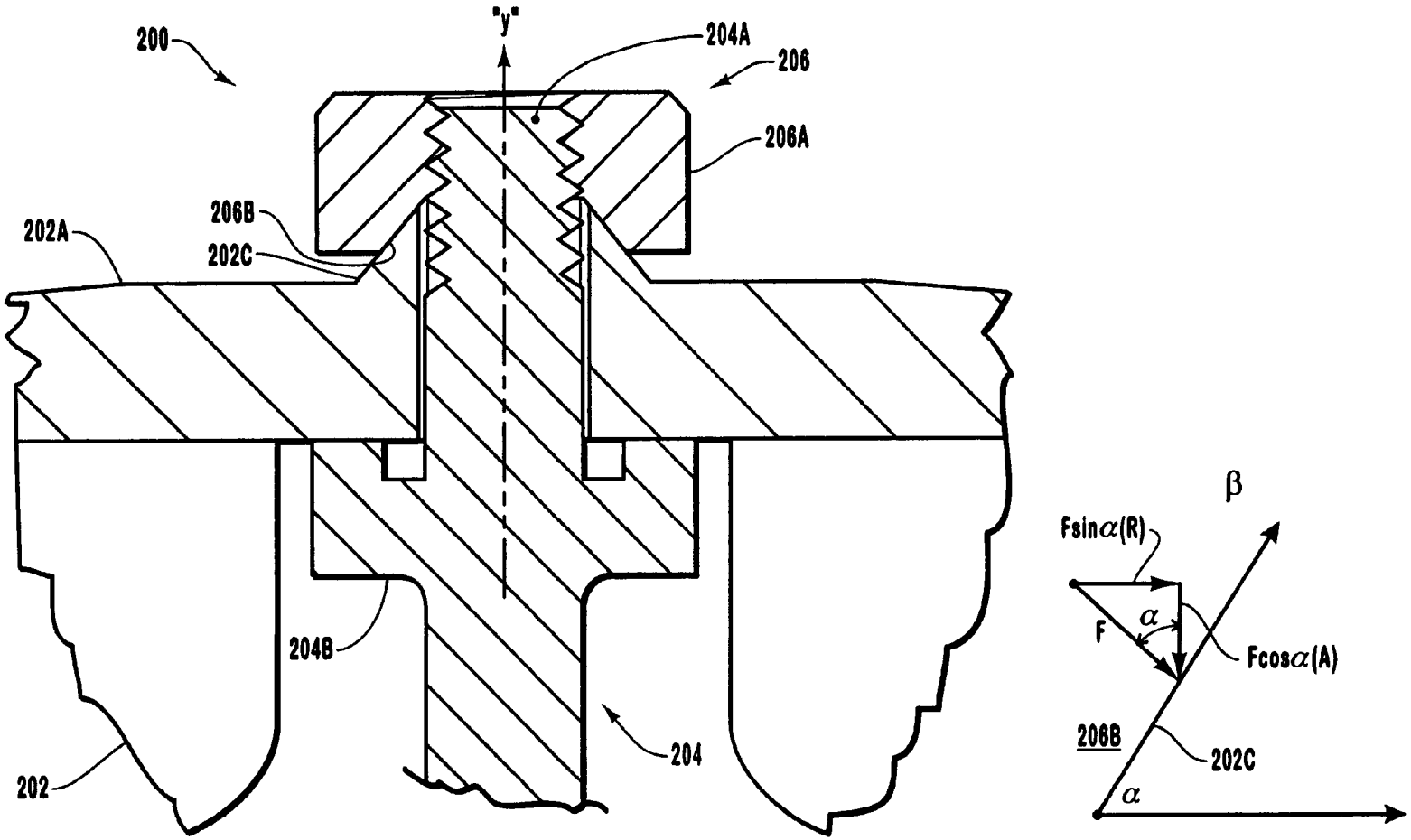
FIG. 3 is a cross-section view of an embodiment of the integrated component mounting system illustrated in FIG. 2A.
FIG. 3A is a diagram depicting exemplary forces exerted on the mounted component by the nut.

Directing attention now to FIGS. 3A and 3B, and with continuing attention to FIG. 2, various details are provided regarding the operation of the illustrated embodiment of ICMS 200. In general, anode 202 is mounted to shaft 204 so that at least a portion of threaded segment 204A is received within hole 202B defined by anode 202, and anode 202 is oriented such that shaped surface 202C faces shaped surface 206B of nut 206. Anode 202 is then positioned, and securely retained in place, by advancing nut 206 along threaded segment 204A until anode 202 is positioned and secured as desired.

With specific reference now to FIGS. 3A and 3B, details are provided regarding various aspects of the interaction of shaped surface 202C and shaped surface 206B. Note that some of the features and benefits of embodiments of the invention are manifested as ICMS 200 is being assembled, while other features and benefits of embodiments of the invention become more apparent after assembly of ICMS 200 is complete.

With regard to assembly of ICMS 200, as nut 206 is advanced along threaded segment 204A of shaft 204, shaped surface 206B of nut 206 comes into sliding contact with shaped surface 202C of anode 202. As nut 206 is tightened further, shaped surface 206B of nut 206 exerts a force, denoted as "F" in FIG. 3A, on shaped surface 202C of anode 202. The respective geometries of shaped surface 202C and shaped surface 206B permit this force "F" to be exerted in a manner that has various useful implications.

Specifically, such force "F" may be represented as acting along a line generally perpendicular to shaped surface 202C and comprising two components. One component is an axial force, denoted at "A," which can be approximated as (F x cosine $\alpha$) and which acts on shaped surface 202C of anode 202 in a direction generally parallel to axis "y." The other component of force "F" is a radial force, denoted at "R," which can be approximated as (F x sine $\alpha$) and which acts on shaped surface 202C of anode 202 in a direction generally perpendicular to axis "y."

If anode 202 is not centered relative to shaft 204 prior to the tightening of nut 206, the radial force R will be exerted on only a portion-of shaped surface 202C and will thus cause anode 202 to shift in a radial direction. However, as anode 202 shifts, that portion of shaped surface 202C not initially subjected to the radial force moves into contact with nut 206 and is also subjected to the radial force. As a result of this subsequent application of the radial force to such portion of shaped surface 202C, the lateral movement of anode 202 may cease and/or change direction.

Such lateral movements of anode 202 continue until the tightening of nut 206 progresses to the point that a state of static equilibrium is reached wherein the radial force "R" is being exerted on all portions of shaped surface 202C. That is, at static equilibrium, the radial force "R" is exerted uniformly about axis "y." At such time as static equilibrium is established, significant lateral movement of anode 202 will cease. Because a lateral shift of anode 202 generally only occurs when anode 202 is off-center with respect to axis "y," the cessation of lateral motion of anode 202 indicates that anode 202 has achieved a centered position with respect to axis "y." Thus, the means for exerting and transmitting a radial force is effective in, among other things, aiding in the radial positioning of anode 202 and, ultimately, ensuring that anode 202 is centered with respect to shaft 204. The magnitude of the radial force thus exerted may be readily adjusted by tightening, or loosening, as applicable, nut 206.

Note that some embodiments of the invention are configured so that the anode 202, or other component, ultimately achieves a desired off-center position, rather than the centered position described above. Such embodiments may be employed in applications where, for example, it is desired to induce a vibration by way of a rotating off-center component.

As suggested earlier, the means for exerting and transmitting a radial force, exemplarily embodied as nut 206 in combination with shaped surface 206B of nut 206 and shaped surface 202C of anode 202 in FIGS. 3A and 3B, also acts to exert an axial force in at least some instances. In particular, and as suggested in FIGS. 3A and 3B, the axial force "A" acts on anode 202 along an axis generally parallel to longitudinal axis "y." As a result, the axial force "A" is effective in, among other things, positioning anode 202 at a desired location with respect to longitudinal axis "y," as well as retaining anode 202 at such desired location. As with the magnitude of the radial force "R," the magnitude of the axial force "A" may be readily adjusted by tightening, or loosening, as applicable, nut 206.

Finally, at least some embodiments of the present invention include a variety of additional features that contribute to the radial and axial positioning of components such as anode 202. For example, in at least some embodiments of the invention, shaped surface 206B of nut 206 and shaped surface 202C of anode 202 are characterized by a relatively low coefficient of friction so as to enable the position of anode 202 to be readily adjusted as nut 206 advances along shaft 204. Such low friction coefficients may be achieved in various ways, such as by polishing shaped surface 206B and/or shaped surface 202C, or through the application of appropriate coatings or layers to shaped surface 206B and/or shaped surface 202C. Support member 204B and/or anode 202 include similar low friction characteristics in at least some embodiments of the invention.

As the foregoing discussion indicates, embodiments of the present invention include a variety of useful features and advantages. For example, one advantage of embodiments of the present invention is that an assembler can mount a component, anode 202 for example, to shaft 204 and can quickly and easily center such component simply by tightening nut 206. No time-consuming adjustments by the assembler are required because shaped surface 206B of nut 206 and shaped surface 202C of anode 202 cooperate with each other to automatically exert a radial force on anode 202, and thereby adjust the radial position of anode 202, as nut 206 is tightened. At the same time as the component is being automatically centered on shaft 204 by exertion of the radial force, exertion of the axial force serves to establish and maintain the position of the component along the longitudinal axis "y" defined by shaft 204. Thus, the tightening and centering functionalities are both implemented, and simultaneously in at least some cases, by way of nut 206 and shaped surface 206B of nut 206 and shaped surface 202C of anode 202 or, more generally, by the means for exerting and transmitting a radial force.

As another example, embodiments of the present invention are also helpful in preventing "wobble," and other undesirable phenomena often associated with uncentered rotating components, by facilitating the ready and reliable centering of a component on a rotatable shaft. Further, by reducing or eliminating phenomena such as wobbling of the component, embodiments of the invention are thereby effective in reducing vibration and mechanical stresses and strains that typically accompany rotation of uncentered components. These features of embodiments of the present invention are particularly useful in environments such as rotating anode x-ray tubes where the component may be exposed to boost and brake cycles, high rotational speeds and/or high operating temperatures.

Finally, by substantially eliminating or foreclosing radial runout, or lateral motion of components such as anode 202, during operation, embodiments of the present invention provide a stable and reliable mechanical joint which ensures that optimum positioning and balancing of the component are maintained over a wide range of operating conditions. This feature is especially useful in applications such as rotating anode type x-ray tubes where proper orientation of the rotating anode is an important factor in focal spot stabilization, and thus the quality of the image that can be obtained with the x-ray device.

Directing attention now to FIGS. 4 through 7, details are provided concerning various features of alternative embodiments of the invention. Because at least some of the structural and/or operational features of the embodiment illustrated in FIGS. 1 through 3B are also characteristic of the embodiments illustrated in FIG. 4 through 7, the following discussion of FIGS. 4 through 7 will not address those common features and will instead focus primarily on selected differences between such embodiments.

Reference is first made to FIG. 4, where various features of an alternative embodiment of ICMS 300 are illustrated. As indicated there, the ICMS 300 includes a component, anode 302 for example, that defines first and second shaped surfaces 302A and 302B, respectively. In the illustrated embodiment, first and second shaped surfaces 302A and 302B comprise substantially continuous annular surfaces defining inclination angles of $\alpha$ and $\delta$, respectively. Such inclination angles $\alpha$ and $\beta$ may be varied individually or collectively as required to suit particular applications and may be substantially identical to each other or, alternatively, may be of differing values. In general however, any value(s) of inclination angles $\alpha$ and $\delta$ effective in implementing the functionality disclosed herein may be employed.

The ICMS 300 additionally includes a shaft 304, upon which anode 302 is mounted, with a support member 304A that defines a shaped surface 304B arranged for operative contact with second shaped surface 302B of anode 402. The shaft 304 further includes a threaded segment 304C. In the illustrated embodiment, shaped surface 304A comprises a substantially continuous annular surface and is characterized by an inclination angle $\epsilon$. The value of inclination angle $\epsilon$ may be generally the same as the value of inclination angle $\delta$, but may alternatively be varied, either alone or in conjunction with inclination angle $\delta$, as necessary to suit the requirements of a particular application. As with inclination angles $\alpha$ and $\delta$, any value of inclination angle $\epsilon$ that is consistent with implementation of the functionality disclosed herein may be employed.

Finally, ICMS 300 includes a nut 306 that defines a shaped surface 306A, as well as wrench flats 306B, and engages threaded segment 304C so as to, among other things, retain anode 302 on shaft 304. The shaped surface 306A comprises a substantially continuous annular surface characterized by an inclination angle $\beta$. As with inclination angles $\alpha$, $\delta$, and $\epsilon$, any value of inclination angle $\epsilon$ that is consistent with implementation of the functionality disclosed herein may be employed.

Generally, the operational principles of the embodiment of ICMS 300 illustrated in FIG. 4 are similar to those of the embodiment of ICMS 200 illustrated in FIG. 3A. However, in the embodiment illustrated in FIG. 4, the presence of four different shaped surfaces permit two forces, denoted at $F_1$ and $F_2$ in FIG. 4, to be exerted on anode 302. That is, the respective geometries and orientation of first and second shaped surfaces 302A and 302B, shaped surface 304A, and shaped surface 306A permit force $F_1$ to be exerted by nut 306, and force $F_2$ to be exerted by shaft 304 in response to the force exerted by nut 306. As a direct consequence of its geometry then, shaft 304 affirmatively aids in the centering of anode 302, rather than simply providing axial support to anode 202, as in the case of the embodiment illustrated in FIGS. 3A and 3B. This is in contrast with the embodiment illustrated in FIG. 3A wherein the configuration and arrangement of ICMS 200 is such that only a single force is exerted and wherein shaft 204 plays no affirmative role in the centering of anode 202.

In general, forces $F_1$ and $F_2$ each include radial and axial components (not illustrated) and act on anode 302 in a manner substantially similar to that described in connection with the discussion of FIGS. 3A and 3B. Similar to the force "F" represented in FIGS. 3A and 3B, forces $F_1$ and $F_2$ serve to, among other things, aid in the ready and reliable centering of anode 302 with respect to shaft 304. Specifically, the implementation of two forces that is accomplished by the embodiment of ICMS 300 illustrated in FIG. 4 lends an additional degree of stability to the positioning and orientation of anode 302.

Directing attention now to FIG. 5, details are provided regarding various features of another alternative embodiment of the ICMS 400. With the exception of the geometry of the shaped surfaces, discussed below, the embodiment illustrated in FIG. 5 is structurally and operationally similar to the embodiment illustrated in FIG. 4. Specifically, the illustrated embodiment of ICMS 400 includes a component 402, a rotating anode for example, that defines first and second shaped surfaces 402A and 402B, respectively. The first and second shaped surfaces 402A and 402B are substantially annular and form a portion of a circular curve, specifically, an arc of about ninety degrees. Of course, arcs of different magnitudes may likewise be employed. As in the case of the other embodiments disclosed herein, first and second shaped surfaces 402A and 402B need not be annular in every case, but may alternatively comprise a plurality of individual segments spaced apart from each other at regular, or other, intervals.

As an alternative, shaped surfaces that form parabolic curves may be employed. Further, parabolic and circular curve surfaces may be combined in a single embodiment. By way of example, in one embodiment, first shaped surface 402A describes a portion of a circular curve and second shaped surface 402B describes a parabolic curve. In another alternative embodiment, one or both of first and second shaped surfaces 402A and 402B describe concave forms, rather than the convex forms illustrated in FIG. 5. In such an alternative embodiment, the nut and/or shaft would correspondingly define surfaces characterized by convex forms.

With continuing reference to FIG. 5, the illustrated embodiment of ICMS 400 further includes a shaft 404 upon which component 402 is mounted, with a support member 404A that defines a shaped surface 404B arranged for operative contact with second shaped surface 402B of component 402. The shaft 404 further includes a threaded segment 404C. As is generally the case with the other embodiments disclosed herein, shaped surface 404B has a geometry that is generally complementary with the geometry of second shaped surface 402B of component 402.

Specifically, shaped surface 404B comprises a substantially annular convex surface in a form, parabolic for example, that permits shaped surface 404B to cooperate with shaped surface 402B of component 402 to at least partially implement the functionality of ICMS 200 as disclosed herein. As described below, shaped surface 404B, as well as second shaped surface 402B, is eliminated in some alternative embodiments.

As in the case of other embodiments of ICMS 400, shaft 404 cooperates with a nut 406 to retain component 402 in a desired location. In the illustrated embodiment, nut 406 defines a shaped surface 406A, as well as wrench flats 406B, and engages threaded segment 404C so as to, among other things, apply a desired force to component 402 and retain component 402 on shaft 404. Similar to shaped surface 404B, shaped surface 406A comprises a geometry that is generally complementary with the geometry of second shaped surface 402A of component 402. In one alternative embodiment, support member 404A of shaft 404 lacks shaped surface 404B and, instead, generally takes the form of support member 204B, illustrated in FIG. 3A. In this alternative embodiment, only shaped surfaces 402A and 406A are present.

Turning now to FIGS. 6 and 7, various features of two further alternative embodiments are illustrated. As the embodiments illustrated in FIGS. 6 and 7 are quite similar in many regards, the following discussion will focus primarily on FIG. 6 but will address certain distinctions between FIGS. 6 and 7 where appropriate.

As indicated in FIG. 6, ICMS 500 generally includes a component 502 disposed on shaft 504 and retained in place on shaft 504 by a nut 506 that includes wrench flats 506A. The component 502 includes a shaped surface 502A that is configured and arranged to cooperate with a shaped surface 504A defined by shaft 504. As in the case of some alternative embodiments disclosed herein, shaped surfaces 502A and 504A describe, respectively, inclination angles $\alpha$ (alpha) and $\beta$ (beta) having values such that shaped surfaces 502A and 504A are collectively able to facilitate implementation of the functionality disclosed herein. For a given inclination angle $\alpha$, a range of values of inclination angle $\beta$ may be effectively employed, and vice versa. Further, inclination angles $\alpha$ and/or $\beta$ may be varied as required to suit particular applications, or the use of particular materials. As suggested in FIG. 7, shaft 504 also includes a threaded segment 504B configured to engage nut 506.

With specific reference now to nut 506, the illustrated embodiment indicates that nut 506 comprises a nut that, unlike, at least some other alternative embodiments disclosed herein, defines no shaped surfaces. As a consequence of this configuration of nut 506, the illustrated embodiment of ICMS 500 operates in a somewhat different manner to achieve the functionality disclosed herein. Specifically, because nut 506 lacks a shaped surface, nut 506 cannot exert, or contribute to the exertion of, a radial force but rather is capable of exerting only an axial force. However, the exertion of an axial force "$A_0$" on upper surface 502B, by nut 506, causes component 502 to react by imposing force "F" on shaped surface 504A. As discussed elsewhere herein, force "F" has both axial and radial components that serve to, among other things, facilitate ready and reliable centering of component 502 as well as establish and maintain component 502 at a desired location on shaft 504. Thus, in the embodiment of ICMS 500 illustrated in FIG. 6, the means for exerting and transmitting a radial force comprises, in addition to shaped surface 502A and shaped surface 504A, nut 506.

In addition to nut 506, a braze ring 504C may be employed to further aid in the securement of component 502 on shaft 504. In one alternative arrangement, a groove is provided in shaft 504 that is subsequently filled-with a suitable brazing material.

As noted earlier, at least some of the features discussed in conjunction with FIG. 6 are common to the embodiment of ICMS 600 illustrated in FIG. 7. In the embodiment illustrated in FIG. 7, component 602 defines a shaped surface 602A, an upper surface 602B, and further includes a threaded portion 602C. Shaft 604 includes a shaped surface 604A arranged for contact with shaped surface 602A, and further includes a threaded segment 604B that engages both threaded portion 602C as well as nut 606. In this embodiment, nut 606 includes wrench flats 606A and acts as a jam nut and cooperates with the threaded segment 604B to aid in the reliable positioning and retention of component 602 on shaft 604.

Figure 8:
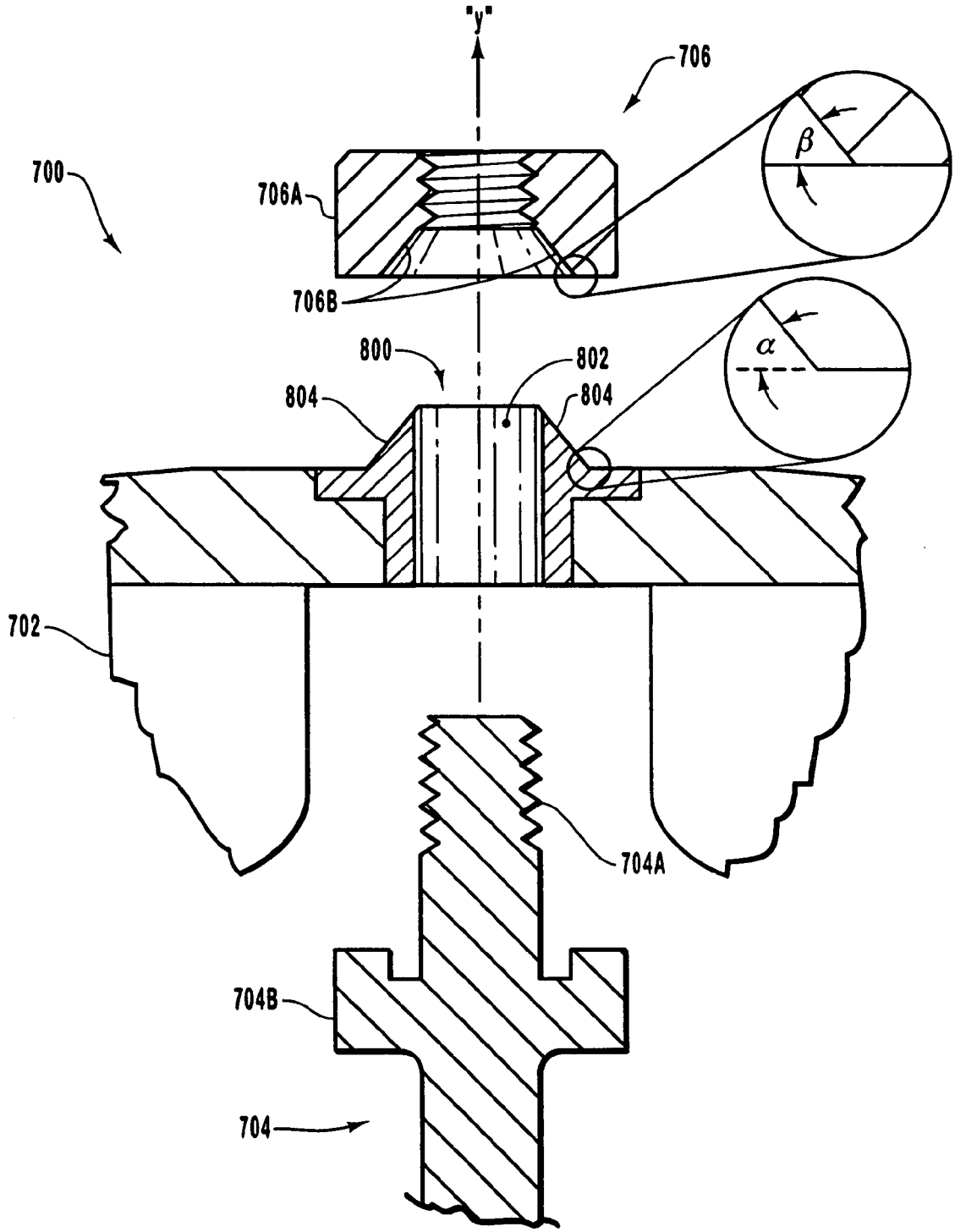
FIG. 8 is an exploded cross-section view illustrating yet another alternative embodiment of an integrated component mounting system wherein one of the shaped surfaces is defined by other than the nut, anode, or shaft.

Directing attention now to FIG. 8, various features of another alternative embodiment of ICMS 700 are illustrated. Generally, the embodiment illustrated in FIG. 8 is operationally and structurally similar to that illustrated in FIG. 3, except with respect to the shaped surface that interacts with the shaped surface of the nut.

As indicated in FIG. 8, ICMS 700 includes a component 702, such as an anode, within which is fitted an interface structure 800. Interface structure 800 defines a hole 802 configured and arranged to receive shaft 704 so that interface structure 800 may reside on support member 704B. When interface structure 800 is so disposed, threaded segment 704A extends through interface structure 800 and is positioned to threadingly engage a nut 706 that includes wrench flats 706A and defines a shaped surface 706B. Interface structure 800 defines a shaped surface 804 which is arranged for contact with shaped surface 706B Interface structure 800 may alternatively be configured so that it defines a shaped surface arranged for contact with a shaped surface defined by shaft 704, similar to the embodiment illustrated in FIG. 7. As another alternative, interface structure 800 may be configured in a manner similar to component 302 and 402 of FIGS. 4 and 5, respectively, in the sense that interface structure 800 may define not one, but two shaped surfaces. In the foregoing exemplary embodiments, interface structure 800 and nut 706 collectively comprise exemplary implementing structure for a means for exerting and transmitting a radial force.

When employed in x-ray tube environments, interface structure 800 comprises materials suitable for use in such environments, and is bonded or otherwise attached to component 702 in a manner, and with materials, suited for such environments. Both the material of interface structure 800, as well as the manner and/or materials used to bond interface structure 800 to component 702, may be varied as necessary to suit the requirements of a particular application.

The present invention may be embodied in other specific forms without departing from its spirit or essential characteristics. The described embodiments are to be considered in all respects only as illustrative and not restrictive. The scope of the invention is therefore described by the appended claims rather than by the foregoing description. All changes which come within the meaning and range of equivalency of the claims are to be embraced within their scope.

What is claimed is:

1. An integrated component mounting system, comprising:

(a) a shaft defining a longitudinal axis;

(b) a component disposed on said shaft; and (c) means for exerting and transmitting a radial force, wherein said means for exerting and transmitting a radial force controls radial movement of said component with respect to said longitudinal axis defined by said shaft.

2. The integrated component mounting system as recited in claim 1, wherein said means for exerting and transmitting a radial force substantially prevents radial movement of said component when said component is in a desired radial position.

3. The integrated component mounting system as recited in claim 1, wherein said means for exerting and transmitting a radial force at least partially controls axial movement of said component along said longitudinal axis defined by said shaft.

4. The integrated component mounting system as recited in claim 3, wherein said shaft further comprises a support member and said means for exerting and transmitting a radial force cooperates with said support member to substantially prevent axial movement of said component when said component is in a desired axial position.

5. The integrated component mounting system as recited in claim 1, wherein said means for exerting and transmitting a radial force moves said component to a desired radial position during assembly of the integrated component mounting system.

6. The integrated component mounting system as recited in claim 5, wherein when said component is in said desired position, said component is centered with respect to said longitudinal axis.

7. The integrated component mounting system as recited in claim 5, wherein when said component is in said desired position, said component is off-center with respect to said longitudinal axis.

8. The integrated component mounting system as recited in claim 1, wherein said means for exerting and transmitting a radial force automatically centers said component with respect to said longitudinal axis during assembly of the integrated component mounting system.

9. The integrated component mounting system as recited in claim 1, wherein said means for exerting and transmitting a radial force secures said component to said shaft.

10. The integrated component mounting system as recited in claim 1, wherein said means for exerting and transmitting a radial force transmits an axial force and a radial force to said component, and said transmission of said axial force and said transmission of said radial force occurs simultaneously.

11. The integrated component mounting system as recited in claim 1, wherein said means for exerting and transmitting a radial force comprises:

(a) a nut configured to engage said shaft;

(b) a first shaped surface defined by said component; and (c) a second shaped surface defined either by said shaft or by said nut and arranged for contact with said first shaped surface.

12. The integrated component mounting system as recited in claim 1, wherein said means for exerting and transmitting a radial force comprises:

(a) a nut configured to engage said shaft;

(b) an interface structure that is attached to the component and defines a first shaped surface; and (c) a second shaped surface defined either by said shaft or by said nut and arranged for contact with said first shaped surface.

13. The integrated component mounting system as recited in claim 1, wherein said component comprises a target anode.

14. An integrated component mounting system, comprising:

(a) a shaft including a support member and defining a longitudinal axis;

(b) a nut configured to engage said shaft;

(c) a component that defines a first shaped surface and is disposed on said shaft between said nut and said support member; and (d) a second shaped surfaced defined either by said shaft or by said nut and arranged for contact with said first shaped surface.

15. The integrated component mounting system as recited in claim 14, wherein said first shaped surface defines a first inclination angle and said second shaped surface defines a second inclination angle.

16. The integrated component mounting system as recited in claim 14, wherein said second shaped surface is defined by said shaft.

17. The integrated component mounting system as recited in claim 14, wherein said second shaped surface is defined by said nut.

18. The integrated component mounting system as recited in claim 14, wherein said first and second shaped surfaces each describe a portion of a circular curve.

19. The integrated component mounting system as recited in claim 14, wherein said first and second shaped surfaces each describe a parabolic curve.

20. The integrated component mounting system as recited in claim 14, wherein said first shaped surface is convex and said second shaped surface is concave.

21. The integrated component mounting system as recited in claim 14, wherein said first shaped surface is concave and said second shaped surface is convex.

22. The integrated component mounting system as recited in claim 14, wherein said second shaped surface is defined by said nut, and a third shaped surface is defined by said component and said third shaped surface is arranged for contact with a fourth shaped surface defined by said shaft.

23. The integrated component mounting system as recited in claim 22, wherein at least two of said first, second, third, and fourth shaped surfaces describe a portion of a circular curve.

24. The integrated component mounting system as recited in claim 22, wherein at least two of said first, second, third, and fourth shaped surfaces describe a parabolic curve.

25. The integrated component mounting system as recited in claim 22, wherein said first, second, third, and fourth shaped surfaces each define an inclination angle.

26. The integrated component mounting system as recited in claim 22, wherein said component comprises a target anode.

27. An integrated component mounting system, comprising:

(a) a shaft including a support member and defining a longitudinal axis;

(b) a nut configured to engage said shaft;

(c) an interface structure defining an opening and a first shaped surface;

(d) a component that defines an opening wherein said interface structure is received, and said component is disposed on said shaft between said nut and said support member so that said shaft is received within said opening defined by said interface structure; and (e) a second shaped surfaced defined either by said shaft or by said nut and arranged for contact with said first shaped surface.

28. The integrated component mounting system as recited in claim 27, wherein said second shaped surface is defined by said shaft.

29. The integrated component mounting system as recited in claim 27, wherein said second shaped surface is defined by said nut.

30. The integrated component mounting system as recited in claim 27, wherein said first shaped surface defines a first inclination angle and said second shaped surface defines a second inclination angle.

31. The integrated component mounting system as recited in claim 27, wherein said first and second shaped surfaces each describe a portion of a circular curve.

32. The integrated component mounting system as recited in claim 27, wherein said first and second shaped surfaces each describe a parabolic curve.

33. The integrated component mounting system as recited in claim 27, wherein said component comprises a target anode.

* * * * *

UNITED STATES PATENT AND TRADEMARK OFFICE

CERTIFICATE OF CORRECTION

PATENT NO. : 7,248,673 B2
APPLICATION NO. : 10/989569
DATED : July 24, 2007
INVENTOR(S) : Miller It is certified that error appears in the above-identified patent and that said Letters Patent is hereby corrected as shown below:

Column 1
Line 22, change "maintain the both the" to --maintain both the--

Column 3
Line 20, change "integrate" to --integrated--

Column 4
Line 18, change "2A;" to --2;--

Column 6
Line 46, change "206A" to --206B--

Column 9
Line 36, change "β" to -- δ --
Line 45, after "anode" change "402" to --302--

Column 11
Line 49, change "unlike," to --unlike--

Signed and Sealed this

Thirtieth Day of November, 2010

David J. Kappos

David J. Kappos
*Director of the United States Patent and Trademark Office*